US005351901A

United States Patent [19]

Scholtysik et al.

[11] Patent Number: 5,351,901

[45] Date of Patent: Oct. 4, 1994

[54] HUB TENSIONING DEVICE

[75] Inventors: Bernd Scholtysik; August Liepold; Jose Toral; Manfred Baumann, all of Munich, Fed. Rep. of Germany

[73] Assignee: BASF Magnetics GmbH, Mannheim, Fed. Rep. of Germany

[21] Appl. No.: 992,833

[22] Filed: Dec. 18, 1992

[30] Foreign Application Priority Data

Dec. 20, 1991 [DE] Fed. Rep. of Germany ... 9115828[U]

[51] Int. Cl.[5] ..... B65H 75/18

[52] U.S. Cl. ..... 242/540; 242/599.2

[58] Field of Search ..... 242/56.9, 72 R, 68.1, 242/68.2, 68.3, 68.5

[56] References Cited

U.S. PATENT DOCUMENTS

| | | | |
|---|---|---|---|
| 2,833,488 | 5/1958 | Keeber | 242/56.9 |
| 4,332,356 | 6/1982 | Damour | 242/56.9 X |
| 4,438,888 | 3/1984 | Seelinger | 242/56.9 |
| 4,541,587 | 9/1985 | Stumpfi et al. | 242/68.5 X |
| 4,978,083 | 12/1990 | Kim | 242/56.9 |

FOREIGN PATENT DOCUMENTS

| | | | |
|---|---|---|---|
| 1197339 | 11/1959 | France | 242/56.9 |

*Primary Examiner*—Daniel P. Stodola
*Assistant Examiner*—Eileen Dunn
*Attorney, Agent, or Firm*—Keil & Weinkauf

[57] ABSTRACT

A tensioning device for hubs, comprising a winding shaft having rotatably and drivably mounted on it individual winding elements as hub holder for hubs with inner cylindrical bores, the tensioning device including measures for locking the hubs in the axial direction on each individual winding element, wherein the hub (1) includes along its inner circumference (3), alongside the inner bore (5) and uniformly distributed over the circumference, a multiplicity of resilient elements (2), which have the form of a bent-off arm which extends in the radial direction from the inner circumference (3) of the hub (1) and is bent off in the circumferential direction, the end (4) of each resilient arm being at a distance from the bending point of the next-following arm.

3 Claims, 2 Drawing Sheets

HUB TENSIONING DEVICE

BACKGROUND OF THE INVENTION

1. Field of the Invention

The invention relates to a tensioning means for hubs, comprising a winding shaft having rotatably and drivably mounted on it individual winding elements for hubs with inner cylindrical bores, the tensioning means including measures for locking in of the hubs in the axial direction on each individual winding element.

2. Description of the Related Art

In winding machines, in particular in combined longitudinal cutting and winding apparatuses, for example for magnetic tapes, the winding shafts in each case receive a large number of hubs. Fitting the winding shaft with hubs is problematical, since the numerous wound hubs are to be drawn off the winding shaft as quickly as possible and replaced in the correct position by empty hubs. The tensioning means should not hinder easy and troublefree displacing of the hubs on the shaft during fitting. Therefore, numerous tensioning means on the winding shaft are already known, such as tensioning rollers, tensioning pins or the like, which are mechanically complicated constructions which escalate the costs of the winding shaft. The difficulties become all the greater if individual winding elements with separate frictions are used.

In the Applicant's German application P 41 21 244, a number of tensioning means known from the prior art are described in detail. Similarly, in the said application a hub tensioning means of the generic type mentioned above is described, in which the tensioning means includes a plurality of segments which are distributed over the circumference of each cylindrical individual winding element, are seated in an annular groove and are loaded by spring elements. Furthermore, in this application FIGS. 6 and 7 show a snap-fitting or centering means for hubs, comprising a bead and a ball thrust piece on the outside of the tensioning means, which make it possible for the hubs to be pushed on axially and centered.

The said tensioning means have a number of disadvantages. Firstly, usually there is no accurate lateral fixing of the hubs. Secondly, the radially acting tensioning elements in the hub holder require a certain installation space, which often can be realized in the design only with difficulty since the hub holder also has to accommodate a stable mounting, which is as exact as possible, and devices suitable for torque generation, for example eddy-current couplings, for driving the individual winding elements.

Furthermore, a centering means for hubs is known, in which each hub has in its hub bore a central notch, in which a projection complementing it on the tensioning means engages. In this case it has been found that hubs with a notch are difficult to produce by injection molding, since they cannot be demolded easily, and producing a notch by machining, for example by turning, is very complicated and expensive.

SUMMARY OF THE INVENTION

It is an object of the present invention to find a tensioning means of the generic type mentioned at the beginning which is of as simple a design as possible, with which the hubs can be pushed axially onto the individual winding elements in a simple and secure way and can also be taken off again after winding and with which, even at high winding speeds, the hubs are seated in a centered manner on the tensioning means without wobbling.

BRIEF DESCRIPTION OF THE DRAWINGS

The invention is explained in further detail below with reference to the drawings, in which.

DESCRIPTION OF THE PREFERRED EMBODIMENTS

Figure 2:
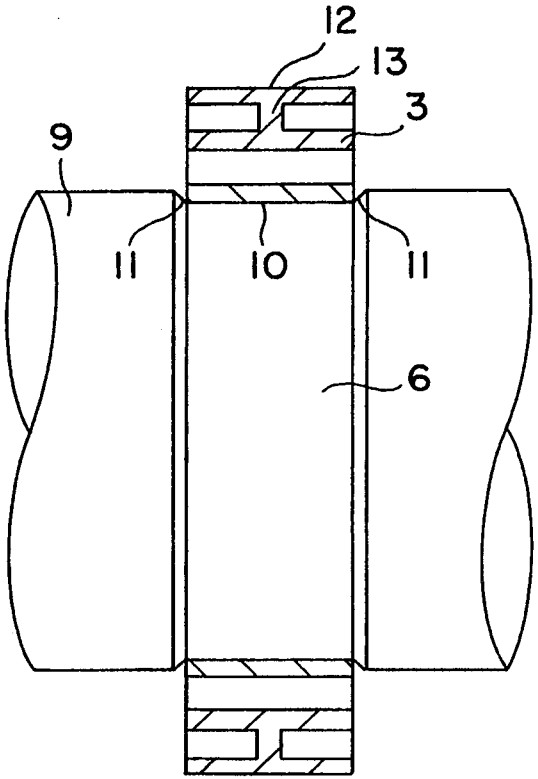
FIG. 2 shows a cross section through a hub according to FIG. 1, which hub is pushed onto a hub holder.
Figure 1:
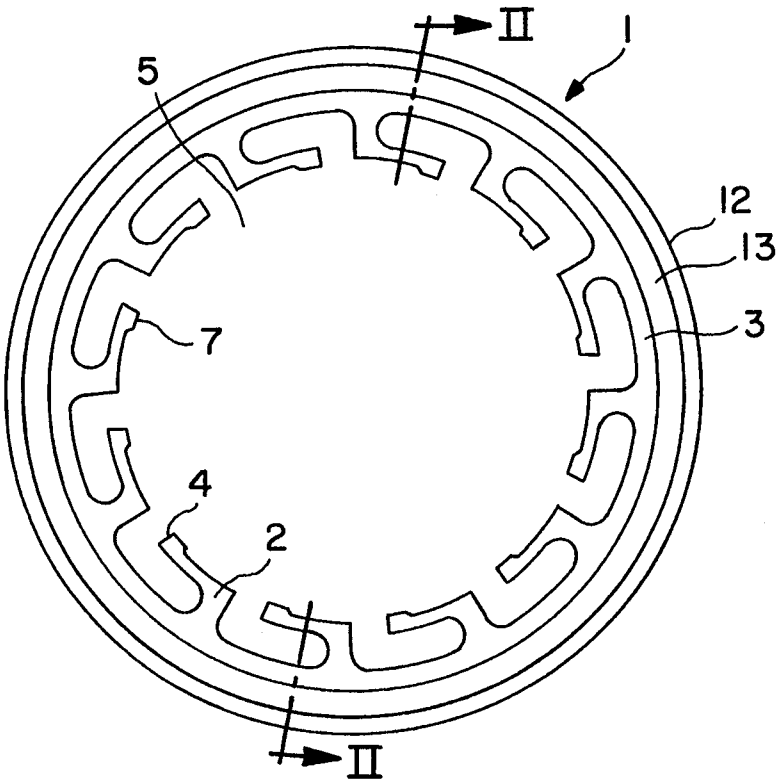
FIG. 1 shows a hub according to the innovation in plan view

As can be seen from FIGS. 1 and 2, the hub (1) according to the invention comprises an inner bore(s), an outer part with the circular-cylindrical surface (12) serving for winding with magnetic tape, a further inner annular cylinder (3) and a radial web (13) lying in between as reinforcing rib, so that this hub has a double-T profile. Such hubs have already been described in the application P 41 05 604 of the same applicant.

From the inner annulus (3) described above there extend a multiplicity of resilient elements (2) which are distributed over the circumference of the hub and have the form of a bent-off arm which extends in the radial direction from the inner annulus (3) of the hub and is bent off in the circumferential direction, the ends (4) of each arm (2) respectively being at a distance from the bending point of the next-following arm (2) to form a clearance (15) between the end (4) of the resilient arm (2) and the bending point of the next-following arm (2). The resilient arms may either run the same way in the circumferential direction or one opposing the other. In a preferred embodiment, the end (4) of the resilient arm (2) is in each case provided with a radially projecting spur (7). During winding of the hub, for example with magnetic tape, the hub is compressed, so that, before winding, the hub rests on the hub holder (6) merely by the spur (7) at the end of the resilient arm, whereas when the hub has been completely wound it rests in place both at the bend of the arm and at the spur, so that good contact of hub and winding shaft (9) or hub holder (6) is ensured.

Figure 3:
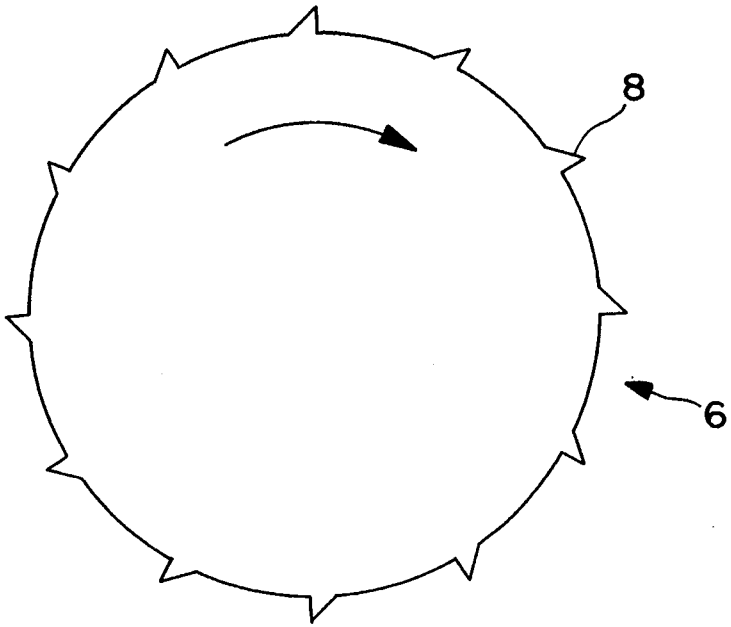
FIG. 3 shows a design of the hub holder for pushing on the hubs according to FIGS. 1 and 2, in longitudinal section

The outer circumference of the HUB holder 6 may be provided (FIG. 3) with steps (8) which interact lockably and drivably with the resilient arms (2) or with the spurs (7) in order to ensure good torque transfer of the winding shaft to the hubs.

Figure 4:
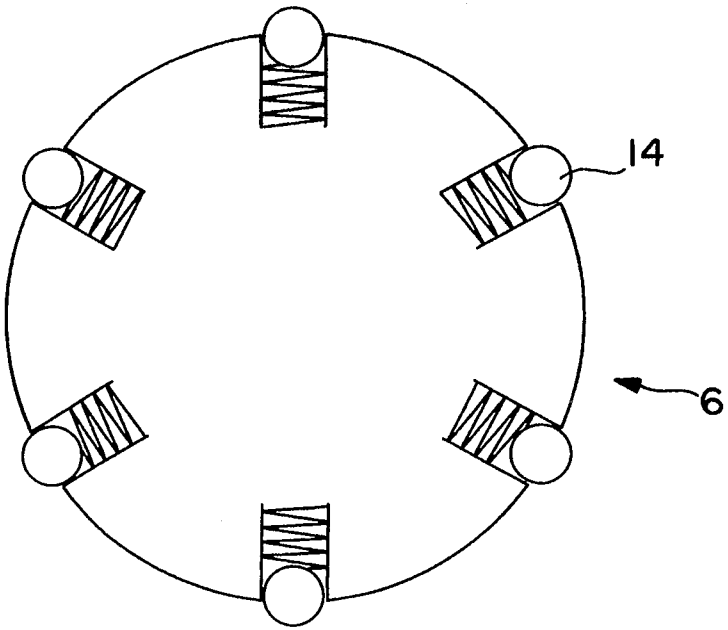
FIG. 4 shows a further design of the hub holder in longitudinal section.

Other suitable means may also serve for transfering the torque from the hub holder to the hub, for example one or more ball thrust pieces (14) which lock into the space between two neighboring resilient arms (2) of the hub (FIG. 4). If the resilience of the resilient arms (2) is adequately great, the frictional connection with the hub holder can also be adequate for torque transfer.

When the ready-wound hubs, which are wound for example with strip-form magnetic tapes (known as pancakes), are received by the customer for further processing, they are fitted for unwinding on receiving spindles which, for example when hubs known as NAB hubs are used, include three driving elements in each case offset by 120° from one another on the spindle. In the case of the hub according to the invention, the arrangement of the resilient arms (2) and their spacing from one another are made such that the hubs can be fitted onto such receiving spindles, the projections described (driving elements) in each case fitting into the spacings between two arms.

When each hub is pushed axially onto the individual winding elements (9) of the hub holder (6), the latter has an annular-cylindrical depression (10), which is revealed by FIG. 2 and the width of which corresponds to the width of the hub. The depressions expediently have sloping run-on edges (11) on both sides, so that in this way the hubs can be pushed on and also taken off again in the axial direction without catching.

In this way, the objects of the invention are completely achieved.

We claim:

1. A winding device comprising a winding shaft having individual hub holders mounted axially there along for individual hubs having inner cylindrical bores, means for locking in of the hubs in the axial direction on each individual hub holder, wherein each hub (1) includes along its inner circumference (3), alongside the inner bore (5) and uniformly distributed over the circumference, a multiplicity of resilient elements (3), which have the form of a bent-off arm which extends in the radial direction from the inner circumference (3) of the hub (1) and is bent off in the circumferential direction, the end (4) of each resilient arm being at a distance from the bending point of the next-following arm, thereby forming a clearance between the end of a resilient arm and the bending point of the next-following, resilient arm, wherein the means for locking in of the hubs are one or more radially spring loaded ball thrust pieces (14) on the outer circumference of the hub holder (6) which lock into the clearance between the neighboring resilient arms.

2. The winding device as claimed in claim 1, wherein the end (4) of the resilient arm has a spur (7) projecting radially int he direction of the hub holder (6).

3. The as claimed in claim 1, wherein each individual hub holder (6) has a circular-cylindrical depression (10) which corresponds to the width of the hub (1) and is shaped on both sides with sloping run-on edges (11) for axially receiving the hubs.

* * * * *

UNITED STATES PATENT AND TRADEMARK OFFICE

CERTIFICATE OF CORRECTION

PATENT NO.: 5,351,901

DATED: October 4, 1994

INVENTOR(S): SCHOLTYSIK et al.

It is certified that error appears in the above-identified patent and that said Letters Patent is hereby corrected as shown below:

IN THE CLAIMS

Claim 1, column 4, line 2:
"(3)" should read -- (2) --

Claim 2, column 4, line 17:
"int he" should read -- in the --

Claim 3, column 4, line 18:
after "The" insert -- winding device --

Signed and Sealed this

Twenty-ninth Day of November, 1994

*Attest:*

Bruce Lehman

BRUCE LEHMAN

*Attesting Officer*

*Commissioner of Patents and Trademarks*